US006743346B2

(12) United States Patent
Gonzalez et al.

(10) Patent No.: US 6,743,346 B2
(45) Date of Patent: Jun. 1, 2004

(54) ELECTROLYTIC SOLUTION FOR ELECTROCHEMICAL DEPOSIT OF PALLADIUM OR ITS ALLOYS

(75) Inventors: José Gonzalez, Bondy (FR); Lionel Chalumeau, Paris (FR); Michel Limayrac, Domont (FR)

(73) Assignee: Metalor Technologies France Sas a French Simplified Joint Stock Company, Courville sur Eure (FR)

( * ) Notice: Subject to any disclaimer, the term of this patent is extended or adjusted under 35 U.S.C. 154(b) by 0 days.

(21) Appl. No.: 10/239,863

(22) PCT Filed: Apr. 5, 2001

(86) PCT No.: PCT/FR01/01021

§ 371 (c)(1),
(2), (4) Date: Oct. 3, 2002

(87) PCT Pub. No.: WO01/77417

PCT Pub. Date: Oct. 18, 2001

(65) Prior Publication Data

US 2003/0183533 A1 Oct. 2, 2003

(30) Foreign Application Priority Data

Apr. 6, 2000 (FR) ..... 00 04381

(51) Int. Cl.[7] ..... C25D 3/56; C25D 3/50; C23C 18/00

(52) U.S. Cl. ..... 205/257; 205/259; 205/265; 106/1.28

(58) Field of Search ..... 205/257, 259, 205/265; 106/1.28

(56) References Cited

U.S. PATENT DOCUMENTS

| | | | | | |
|---|---|---|---|---|---|
| 3,925,170 | A | * | 12/1975 | Skomoroski et al. | 205/143 |
| 3,933,602 | A | * | 1/1976 | Henzi et al. | 205/257 |
| 4,278,514 | A | * | 7/1981 | Morrissey | 205/265 |
| 4,297,177 | A | * | 10/1981 | Fletcher et al. | 205/148 |
| 4,767,507 | A | * | 8/1988 | Wilkinson | 205/250 |

FOREIGN PATENT DOCUMENTS

| | | |
|---|---|---|
| GB | 1051383 | * 12/1966 |
| JP | 57047891 | 3/1982 |
| JP | 6340983 | 12/1994 |

* cited by examiner

*Primary Examiner*—Edna Wong
(74) *Attorney, Agent, or Firm*—Dennison, Schultz, Dougherty & MacDonald

(57) ABSTRACT

An aqueous electrolysis bath of acidic pH for the electrochemical deposition of palladium and its alloys, the bath containing a palladium compound and optionally at least one compound of a secondary metal to be co-deposited in the form of an alloy with the palladium. The bath also contains ethylenediamine as a palladium complexing agent, and an organic brightening agent, 3-(3-pyridyl)acrylic acid, 3-(3-quinolyl)acrylic acid or a salt thereof. The invention is also directed to a process for the electroplating of palladium or a palladium alloy utilizing an electrolysis bath as defined above by using current densities of between 0.5 and 150 A/dm$^2$.

23 Claims, No Drawings

ELECTROLYTIC SOLUTION FOR ELECTROCHEMICAL DEPOSIT OF PALLADIUM OR ITS ALLOYS

BACKGROUND OF THE INVENTION

The present invention relates to an electrolysis bath for the electrochemical deposition of palladium or its alloys and to a process for the electroplating of palladium or one of its alloys.

The electrical contacts and the connectors used in the field of electronics receive, as a finish, thin layers of electroplated precious metals which have to be suitably bright, have good ductility, be non-porous and have corrosion resistance, frictional resistance and low contact resistance. Industry started by using deposits of gold hardened with small amounts of codeposited nickel or cobalt, often referred to as hard gold. Palladium is a precious metal whose deposits have a lower density (12 g/cm$^3$) than those of hard gold (17.3 g/cm$^3$); it also has a greater hardness and a lower porosity. Being less expensive, palladium and its alloys were considered suitable gold substitutes for the majority of applications. As a finish in a wide variety of applications, industry uses thin deposits (also called flash deposits) of gold on palladium or palladium alloys. The main palladium alloys used are palladium-nickel or palladium-silver alloys. Techniques commonly used for the electroplating of palladium and its alloys are the barrel, the vibrating basket, the rack, batch metallization, high-speed continuous metallization (or jet plating) or pad metallization. Industry is constantly in search of more efficient electrolysis baths and processes. Palladium and its alloys are also used for decorative applications as an undercoat or finish.

State of the Art Concerning Ammoniacal Baths

The majority of palladium and palladium alloy baths currently on the market are ammoniacal baths most frequently containing chloride ions. These baths nevertheless have a high nuisance factor, both in terms of the operators' health and in terms of corrosion of the equipment, and they require a large number of maintenance operations.

Aqueous ammonia tends to evaporate at ambient temperature and many commercial baths, particularly "high-speed" baths, operate at between 40 and 60° C. These baths emanate large quantities of gas in the treatment plants; these vapors not only irritate the operators' respiratory tracts, but also are corrosive towards all surrounding cuprous metals, including the parts of pieces not immersed in the electrolyte.

Furthermore, the intense evaporation of aqueous ammonia causes a rapid drop in the pH and the volume of these electrolytes and obliges the users to make incessant and expensive additions of aqueous ammonia and pH adjustments. This maintenance is essential, including after every period in which the electrolyte is not in use.

Ammoniacal baths are conventionally alkaline baths operating in a pH range of between 8 and 13. In the case of metallization on nickel, for example, when the piece is immersed the alkalinity of the electrolyte favors passivation of the nickel, which can cause a lack of adhesion of the palladium alloy deposits.

When chlorides are present, they are the cause of yet more trouble:

- The corrosion of stainless steel equipment is facilitated, resulting in electrolyte contamination.
- During electrolysis, an insoluble yellow palladium salt is generated on the surface of platinized titanium anodes, resulting in multiple difficulties for all applications of the jet plating or continuous selective pad metallization type.

State of the Art Concerning Non-Ammoniacal Baths

The first baths of this type to have been described were pure palladium baths in very acidic media free of organic amines. They were difficult to use. In fact, at pH values of between 0 and 3, the substrates are attacked too strongly. Furthermore, many of these formulations contain chlorides.

A second type consists of pure palladium or palladium alloy baths containing organic amines, which operate at 40 to 65° C., typically in a pH range of 9 to 12, i.e. under strongly alkaline conditions. At these high pH values and these temperatures, polyamines tend to evaporate appreciably and to rapidly become carbonated and produce crystals. Furthermore, under these conditions, the passivation of nickel-plated substrates is even greater than in ammoniacal baths. To overcome the lack of adhesion, it is necessary to palladium-plate the substrates beforehand in a preliminary step, thereby increasing the cost price of these deposits accordingly.

A third type of pure palladium baths containing organic amines is described in particular in patent U.S. Pat. No. 4,278,514. These baths, whose pH values are intermediate at between 3 and 7, generally contain phosphates and use a compound of the imide type, such as succinimide, as a brightening agent. In such baths, the allowable current densities are below 4 A/dm$^2$. Furthermore, these baths contain pure palladium and are therefore mainly intended for decorative purposes.

These baths generally use phosphate buffers effective for the intended alkaline pH values. In certain cases, however, the incorporation of traces of phosphorus in the deposits can influence their quality and, in particular, can detract from their brightness.

On the other hand, compounds of the imide type are capable of improving the brightness of these pure palladium baths at low current densities, but the maximum current densities giving bright deposits do not exceed 4 A/dm$^2$. Furthermore, to obtain this brightening action, imides are added in large amounts. Now, imides are strong complexing agents and their concentration therefore has a substantial influence on the complexation of any secondary metal incorporated. This makes it too difficult to control the composition of alloys under conditions of suitable brightness.

There is therefore a need for a novel process which excludes the use of aqueous ammonia, chlorides, phosphates and imides and which makes it possible to deposit stable alloys of bright appearance, optionally at very high speed, to give adherent ductile deposits without palladium plating beforehand. The pH of these baths should remain in the weakly acidic range. These baths should also be able to be associated with a metal reloading process capable of avoiding rapid concentration of the salts so as to obtain a long life.

None of the processes currently on the market is fully satisfactory.

An optimal formulation capable of meeting all these demands is precisely what the present invention proposes.

A problem which arises particularly in the case of electronic applications is that of finding a brightening agent which is effective at very high current density in a non-ammoniacal medium. In fact, as explained above, many brightening agents—and this applies particularly to those of the imide type—only enable bright deposits to be obtained at moderate or low current densities. In non-ammoniacal baths, the known commercial brightening agents, such as nicotinamide or compounds of the sulfonate type, are incapable of extending the brightness of the deposits to high current densities, particularly those of between 15 and 150 A/dm$^2$ that are desirable in "high-speed" electroplating baths.

The present invention is aimed particularly at solving this problem by proposing the use of well-defined brightening agents capable of being used under the ideal conditions mentioned above.

U.S. Pat. No. 4,767,507 describes gold electroplating baths which use two specific brightening agents, namely 3-(3-pyridyl)acrylic acid or 3-(3-quinolyl)acrylic acid.

In the gold baths described in said document, these brightening agents exhibit a very good stability, even when used in very small amounts. They make it possible to extend the brightness to high current densities.

SUMMARY OF THE INVENTION

It has now been established that these brightening agents can also be used in electrolysis baths for the electrochemical deposition of palladium or its alloys in the presence of ethylenediamine acting as a palladium complexing agent. It has been demonstrated in particular that, in such baths, these brightening agents prove particularly active at high current densities, even in very low concentration.

It has thus been possible, by using these brightening agents, to prepare baths capable of being used in high-speed electroplating processes employing current densities analogous to or even higher than those used in the most efficient ammoniacal baths. For such applications, it has been possible to produce bright deposits of 0.1 to 6 $\mu$m at current densities of between 0.5 and 150 A/dm$^2$.

Furthermore, the invention has made it possible to find conditions under which, in the absence of chlorides and aqueous ammonia, the electroplating can be carried out without depositing insoluble salts on the anodes; this makes it possible to envisage applications in jet plating and in continuous selective metallization of the pad metallization type.

More precisely, according to one of its essential characteristics, the invention relates to an aqueous electrolysis bath of acidic pH for the electrochemical deposition of palladium or its alloys, said bath comprising a palladium compound and optionally at least one compound of a secondary metal to be codeposited in the form of an alloy with the palladium, and also comprising ethylenediamine as a palladium complexing agent, and an organic brightening agent, characterized in that said brightening agent is 3-(3-pyridyl)acrylic acid, 3-(3-quinolyl)acrylic acid or one of their salts, preferably one of their alkali metal salts, for example a sodium or potassium salt.

The bath of the invention makes it possible to deposit palladium or palladium alloys, particularly alloys containing from 60 to 100% of palladium and from 40 to 0% of one or more secondary metals such as nickel, cobalt, iron, indium, gold, silver or tin.

As regards both their constitution and their maintenance, the baths according to the present invention are totally free of aqueous ammonia.

DETAILED DESCRIPTION OF THE INVENTION

The complexing agent used in the baths is ethylenediamine, which has a very low volatility at acidic pH, so there is no emission of vapors that irritate the operators' respiratory tracts. Being capable of operating at 75° C. with no really perceptible odor, these baths therefore allow higher operating temperatures than those used with ammoniacal baths (40 to 60° C.), this being of value for high-speed electronic deposits.

With the absence of corrosive vapors, the surrounding cuprous metals are not attacked and there is no contamination of the bath with copper. A number of pickling and cleaning operations are therefore avoided.

For the same reasons, the pH remains unchanged in the absence of electrolysis and the pH adjustments are much smaller during electrolysis. The variations in the volume of the bath correspond only to the evaporation of water at the working temperature and to the losses through entrainment.

The electrolysis baths of the invention have a weakly acidic pH preferably of between 3 and 5. In fact, in this pH range, the baths of the invention prove particularly stable. This pH range is particularly suitable for baths containing nickel or cobalt, whose hydroxides would be likely to precipitate at pH values of between 6 and 7, and makes it possible to avoid obtaining cloudy deposits, as is the case for certain baths with a pH of between 5 and 6.

In the preferred pH range between 3 and 5, the brightness of the deposits obtained is generally enhanced by the presence of a secondary metal acting as an inorganic brightening agent, in a manner analogous to that observed in acidic gold baths.

Thus the electrolysis bath will advantageously contain between 0 and 60 g/l of at least one metal acting as an inorganic brightening agent.

One of the features of the baths according to the present invention is that they operate at weakly acidic pH values preferably of between 3 and 5.

These baths therefore do not have the disadvantages of the first over-acidic baths capable of attacking the substrate; nevertheless, they do not necessitate prior palladium plating. Conversely, at these pH values, a nickel-plated substrate does not become passivated on entering the electrolyte, as is the case with alkaline baths; the deposit is always very adherent.

These pH values and the possibility of depositing at high temperature are the most favorable conditions for obtaining non-porous deposits.

As explained above, the baths of the invention are intended for depositing palladium or its alloys, particularly alloys containing at least one secondary metal, such as nickel, cobalt, iron, indium, gold, silver or tin, in proportions of 0.1 to 40%.

The baths of the invention advantageously contain from 1 to 100 g/l of palladium.

In another variant of the invention, they contain at least one secondary metal selected from the group consisting of nickel, cobalt, iron, indium, gold, silver and tin, at a concentration of between 0.1 and 60 g/l.

As explained above, one of the essential constituents of the bath of the invention is ethylenediamine, which serves to complex and hence solubilize the palladium in the bath. This ethylenediamine is contained in the bath in an amount sufficient to complex the palladium and render it soluble in said bath, preferably at a concentration of between 2 and 200 ml/l.

Finally, the specific brightening agent used according to the invention, namely 3-(3-pyridyl)acrylic acid, 3-(3-quinolyl)acrylic acid or one of their salts, is contained in the bath at concentrations advantageously of between 0.01 and 3 g/l.

Of these two brightening agents, it will be particularly advantageous to use 3-(3-pyridyl)acrylic acid and more particularly advantageous to use the trans isomer of this acid.

As explained above, in contrast to the brightening agents of the prior art, these two brightening agents can be used at relatively low concentrations and at high current densities, particularly at current densities ranging up to 150 $A/dm^2$, which makes it possible to envisage applying the baths of the invention particularly as high-speed baths for producing bright deposits. They can also be used for applications of the jet plating and continuous selective metallization type.

Furthermore, the electrolysis baths of the invention can contain various additives conventionally used in electroplating baths, such as conducting salts, buffers for stabilizing the pH, wetting agents and additives for reducing the internal voltages of the electrolytic deposits.

These various additives will advantageously be chosen so as not to introduce unwanted ions into the electrolysis bath and particularly so as not to introduce either chloride or phosphoric acid into the electrolysis bath.

Thus the baths of the invention advantageously contain at least 20 g/l of at least one conducting salt. This conducting salt will advantageously be selected from the group consisting of sodium sulfate, potassium sulfate and mixtures thereof.

The buffers for stabilizing the pH will preferably be of the acetic, citric, boric, lactic, malic, phthalic, acrylic, tartaric, oxalic or succinic type.

Wetting agents will advantageously be used. The preferred wetting agents according to the invention will be cetyltrimethylammonium bromide or iodide.

To avoid internal tensions, sodium saccharinate will advantageously be incorporated in the electrolysis bath.

In different variants which are particularly advantageous, the invention proposes conditions under which, in particular, the use of chlorides can be totally avoided.

The invention also proposes conditions under which loading of the bath with ions is avoided as far as possible so as to improve its life.

Thus, to avoid using chlorides, the palladium is advantageously introduced in the form of the sulfate.

Thus the baths according to the present invention are advantageously free of chlorides and the base anion of these baths is advantageously sulfate. It is in fact known that sulfate anions are often used in electroplating because they react at the electrodes much less readily than nitrite or sulfite ions, whose concentrations are much more difficult to maintain at a stable level in the electrolyte. These fluctuations in composition can result in cloudy deposits. In contrast to these formulations, the baths of the invention have a very good stability.

Furthermore, it is well known that the life of an electroplating bath can be appreciably prolonged by avoiding the accumulation of chemical species during the operation of said bath, so as to avoid saturating the electrolyte.

Thus, according to the invention, the palladium is advantageously introduced in the form of a compound specifically adapted to this purpose. This compound, which in itself is a novel compound, forms the subject of a patent application filed on the same date as the present patent application. More precisely, this compound, which takes the form of a water-insoluble salt, has the advantage of being convertible in the presence of excess ethylenediamine to a soluble complex as soon as it is introduced into the bath. Furthermore, by virtue of its chemical composition, this compound enables the palladium to be introduced with a much smaller amount of counterions (sulfate) than in the prior art. In fact, in the prior art, the palladium was introduced into the electrolysis baths either in the form of one of its salts, for example its sulfate, or, if need be, directly in the form of the water-soluble palladium sulfate/ethylenediamine complex.

More precisely, the palladium is particularly advantageously introduced into the electrolysis bath of the invention in the form of a solid salt of palladium sulfate and ethylenediamine which comprises from 31 to 41% by weight of palladium and in which the molar ratio $[SO_4]$:[Pd] is between 0.9 and 1.15 and the ratio [ethylenediamine]:[Pd] is between 0.8 and 1.2.

A method has been specially developed for synthesizing palladium sulfate complexed by a single ethylenediamine in the form of a solid salt. This salt, although insoluble in water, is soluble in baths in which an excess of complexing agent is always present. This salt is very advantageous for readjusting the palladium concentration; its manufacture is described in detail below.

Still with the same concern to avoid loading the electrolysis bath with counterions, when one or more alloying metals are codeposited, i.e. consumed, it has been found most appropriate to reload the baths with these metals in the form of the carbonates. In fact, carbonates react in acidic media to form $CO_2$, which rapidly escapes in gaseous form at the time of addition.

$$CO_3^{2-}+2H^+ \rightarrow H_2O+CO_2$$

This reaction takes place when the metal carbonate is added to the electrolyte. With this system the secondary metals can be readjusted without leaving any anions in the bath, so this system makes it possible to prolong the life of the baths of the present invention.

Another way of introducing the metals, still with the same concern to avoid loading the bath with counterions, consists in introducing them in the form of their hydroxides.

The secondary metals may also be introduced in the form of the sulfates.

In general, the secondary metals will advantageously be introduced in the form of the sulfates, carbonates, hydroxides or mixtures thereof.

Thus, by preferably avoiding the presence of chlorides, the baths of the invention make it possible to prolong the life of the electroplating equipment by preventing its corrosion.

According to another of its features, the invention further relates to a process for the electroplating of palladium or a palladium alloy, characterized in that it comprises operating an electrolysis bath as defined above by using current densities of between 0.5 and 150 $A/dm^2$.

The process of the invention can be applied particularly advantageously to electronic applications, where it is sought to work at the maximum deposition rate and where the desired deposits must be bright, ductile and non-porous, inter alia. To obtain high productivities, the baths have to operate at the highest possible current density, and a high temperature and high agitation rate are often necessary. Baths based on ethylenediamine allow higher operating temperatures than those used with ammoniacal baths prone to the generation of gaseous emanations.

By virtue of the concomitant presence of ethylenediamine as complexing agent and one of the two specific brightening agents of the invention in a pH range preferably of between 3 and 5, using the baths of the invention makes it possible appreciably to extend the brightness to high and very high current densities. The maximum accessible current density that gives bright deposits is then proportional to the amount of this brightening agent.

The specific brightening agent of the invention can be used in palladium and palladium alloy baths, where it is also very effective as a brightening agent at high current densities and even at very low concentration.

In their high-speed version, the baths of the invention therefore allow current densities analogous to or higher than those of the most efficient ammoniacal baths. Depending on the application, bright deposits of 0.1 to 6 $\mu$m can be produced at current densities of between 0.5 and 150 A/dm$^2$.

However, the baths of the invention can also be used at lower speeds and current densities, particularly in decorative applications.

There is no formation of insoluble salt on platinized titanium anodes. This feature allows jet plating applications as well as continuous selective metallizations of the pad metallization type.

In the electroplating process of the invention, the anodes are insoluble anodes preferably made of platinized titanium, platinum coated with iridium oxide, or a precious metal such as platinum. Furthermore, the cathode consists of a metallized substrate.

The preferred formulations of baths according to the present invention can be described (without implying a limitation) by the following general composition, in which the concentrations of metal derivatives (palladium and optionally alloying metals) are based on the metal and in which the palladium is advantageously introduced in the form of a palladium sulfate/ethylenediamine compound with molar ratios [$SO_4$]:[Pd] and [ethylenediamine]:[Pd] of 0.9 to 1.15 and 0.8 to 1.2 respectively:

| | |
|---|---|
| Palladium | 1 to 100 g/l |
| Alloying metal selected from Ni, Co, Fe, In, Au, Ag and Sn | 0 to 60 g/l |
| Ethylenediamine | 2 to 200 ml/l |
| 3-(3-Pyridyl)acrylic acid or 3-(3-quinolyl)acrylic acid | 0.01 to 3 g/l |
| Sodium sulfate | >20 g/l |
| The operating conditions are advantageously as follows: | |
| pH | 3 to 5 |
| Temperature | 10 to 75° C. |
| Agitation | moderate to very vigorous |
| Current density | 0.5 to 150 A/dm$^2$ |
| Anode | platinized titanium |

EXAMPLES

In the Examples the concentrations of palladium and alloying metals are based on the metal.

The Examples which follow illustrate the good performance characteristics of the baths of the invention.

a) In all these Examples, the substrate to be metallized is prepared by an appropriate procedure that depends on the nature of the metal. For example, copper or nickel substrates are first degreased electrolytically; after rinsing with water, the substrate is depassivated in dilute sulfuric acid of 5–20% by volume and rinsed with deionized water before being immersed in one of the electrolytes of the invention.

Certain additives may optionally be introduced. Thus:

Sodium sulfate can be used as a conducting salt, but it is also possible to use potassium sulfate or a mixture of both salts.

An acetic, citric or boric buffer, or any other buffer system which is effective over the pH range in question, can be used to stabilize the pH of the bath.

A wetting agent can be added to avoid the pitting caused by the release of hydrogen on the pieces. A cationic or non-ionic wetting agent is suitable, it being possible, for example, to use very small amounts of cetyltrimethylammonium iodide or bromide.

An agent for reducing internal tensions may be added for decorative applications, it being possible in certain cases to add very small amounts of sodium saccharinate.

b) The palladium concentration is readjusted by the addition of a compound, hereafter denoted by A, prepared by the following procedure:

Starting material: an acidic solution of palladium nitrate

Addition of sulfuric acid in a molar ratio [$H_2SO_4$]:palladium of 1.0 to 1.7

Distillation of a mixture of water and nitric acid

Evaporation to dryness

Redissolution of the palladium sulfate in water

Addition to a dilute solution of ethylenediamine in a molar ratio [ethylenediamine]:[palladium] of 0.8 to 1.2

Reaction time at ambient temperature, with agitation: >12 h

Filtration, drying

The yellow-colored salt of palladium sulfate and ethylenediamine contains approximately 31 to 41% of palladium and has molar ratios [$SO_4$]:[Pd] and [ethylenediamine]:[Pd] of 0.9 to 1.15 and 0.8 to 1.2 respectively; it is hereafter denoted by A.

This method of adding the palladium to the electrolyte can be used for the initial preparation of the bath and for the palladium readjustments during operation.

Example 1

High-Speed Palladium Bath

| | |
|---|---|
| Palladium (introduced in the form of compound A) | 17 to 23 g/l |
| Nickel (in the form of sulfate) | 0.2 to 0.5 g/l |
| Ethylenediamine | 55 to 75 ml/l |
| Trans-3-(3-pyridyl)acrylic acid | 0.22 to 0.38 g/l |
| Sodium sulfate | 20 to 50 g/l |
| Operating conditions: | |
| pH (sulfuric acid/sodium hydroxide) | 3.5 to 4.5 |
| Temperature | 40 to 75° C. |
| Agitation | vigorous to very vigorous |
| Current density | 5 to 42 A/dm$^2$ |
| Anode | platinized titanium |

This bath, in which the nickel acts solely as a brightening agent, deposits palladium with a purity of more than 99.9%; the deposit is mirror-bright, white and ductile with a low resistivity, a low porosity and a good corrosion resistance.

Example 2

High-Speed Palladium-Nickel Bath

| | |
|---|---|
| Palladium (introduced in the form of compound A) | 17 to 23 g/l |
| Nickel (in the form of sulfate) | 9.0 to 13.0 g/l |
| Ethylenediamine | 55 to 75 ml/l |
| Trans-3-(3-pyridyl)acrylic acid | 0.22 to 0.38 g/l |
| Sodium sulfate | 20 to 50 g/l |

-continued

| Operating conditions: | |
|---|---|
| pH (sulfuric acid/sodium hydroxide) | 3.5 to 4.5 |
| Temperature | 60 to 75° C. |
| Agitation | vigorous to very vigorous |
| Current density | 21 to 56 A/dm$^2$ |
| Anode | platinized titanium |
| The mean results are as follows: | |
| Deposition rate at 70° C. and 28 A/dm$^2$ | 1 μm in 10 seconds |
| Deposition rate at 70° C. and 42 A/dm$^2$ | 1 μm in 7 seconds |
| Deposition rate at 70° C. and 56 A/dm$^2$ | 1 μm in 5 seconds |
| Cathode efficiency at 70° C. and 56 A/dm$^2$ | 87.2% |

This bath deposits the alloy palladium 80%-nickel 20%. The 0.1 to 6 μm deposit is mirror-bright and ductile with a low contact resistance and a Vickers hardness of 390 HV under 100 gf (measured according to ISO 4516 (1980)). The deposits, checked according to ISO 4524/3 (85), are non-porous, have a good corrosion resistance and, for a thickness of 0.5 to 6 μm, satisfy the CASS TEST defined by ISO 9227 (1990). They also have a good frictional resistance and pass the BRITISH TELECOM test.

Example 3

High-Speed Palladium-Cobalt Bath

| | |
|---|---|
| Palladium (introduced in the form of compound A) | 17 to 23 g/l |
| Cobalt (in the form of sulfate) | 6.0 to 9.0 g/l |
| Ethylenediamine | 55 to 75 ml/l |
| Trans-3-(3-pyridyl)acrylic acid | 0.22 to 0.38 g/l |
| Sodium sulfate | 20 to 50 g/l |
| Operating conditions: | |
| pH (sulfuric acid/sodium hydroxide) | 3.5 to 4.5 |
| Temperature | 60 to 75° C. |
| Agitation | vigorous to very vigorous |
| Current density | 21 to 56 A/dm$^2$ |
| Anode | platinized titanium |

This bath deposits the alloy palladium 75%-cobalt 25%. The 0.1 to 6 μm deposit is mirror-bright, ductile and hard with a low contact resistance. The deposits are non-porous and have a good corrosion resistance and frictional resistance.

Example 4

Palladium Bath for Decorative Purposes

| | |
|---|---|
| Palladium (introduced in the form of compound A) | 17 to 23 g/l |
| Nickel (in the form of sulfate) | preferably 0.01 to 0.5 g/l |
| Ethylenediamine | 55 to 75 ml/l |
| Trans-3-(3-pyridyl)acrylic acid | 0.10 to 0.38 g/l |
| Sodium sulfate | 20 to 50 g/l |
| Operating conditions: | |
| pH (sulfuric acid/sodium hydroxide) | 3.5 to 4.5 |
| Temperature | 30 to 75° C. |
| Agitation | moderate |
| Current density | 0.5 to 5 A/dm$^2$ |
| Anode | platinized titanium |

This bath, in which the nickel acts solely as a brightening agent, deposits palladium with a purity of >99.9%. The 0.2 to 6 μm deposit is mirror-bright, white, ductile and free of cracks. The deposits are non-porous and have a good corrosion resistance and frictional resistance.

Example 5

Palladium-Nickel Bath for Decorative Purposes

| | |
|---|---|
| Palladium (introduced in the form of compound A) | 6 to 9 g/l |
| Nickel (in the form of sulfate) | 18.0 to 22.0 g/l |
| Ethylenediamine | 55 to 75 ml/l |
| Trans-3-(3-pyridyl)acrylic acid | 0.02 to 0.15 g/l |
| Sodium sulfate | 20 to 50 g/l |
| Operating conditions: | |
| pH (sulfuric acid/sodium hydroxide) | 3.5 to 4.5 |
| Temperature | 55 to 65° C. |
| Agitation | moderate |
| Current density | 1 to 5 A/dm$^2$ |
| Anode | platinized titanium |

This bath deposits the alloy palladium 80%-nickel 20%. The 0.2 to 6 μm deposit is mirror-bright, white, ductile and free of cracks. The deposits are non-porous and have a good corrosion resistance and frictional resistance.

Example 6

Palladium-Cobalt Bath for Decorative Purposes

| | |
|---|---|
| Palladium (introduced in the form of compound A) | 10 to 14 g/l |
| Cobalt (in the form of sulfate) | 7.5 to 8.5 g/l |
| Ethylenediamine | 55 to 75 ml/l |
| Trans-3-(3-pyridyl)acrylic acid | 0.02 to 0.15 g/l |
| Sodium sulfate | 20 to 50 g/l |
| Operating conditions: | |
| pH (sulfuric acid/sodium hydroxide) | 3.5 to 4.5 |
| Temperature | 20 to 45° C. |
| Agitation | moderate |
| Current density | 1 to 8 A/dm$^2$ |
| Anode | platinized titanium |

This bath deposits the alloy palladium 70%-cobalt 30% for decorative applications. The 0.2 to 6 μm deposit is mirror-bright, ductile and free of cracks. The deposits are non-porous and have a good corrosion resistance and frictional resistance.

What is claimed is:

1. An aqueous electrolysis bath of acidic pH for the electrochemical deposition of palladium or palladium with at least one secondary metal to be co-deposited with the palladium in the form of an alloy thereof, said secondary metal being selected from the group consisting of nickel, cobalt, iron, indium, silver and tin, said bath comprising a palladium compound and optionally at least one compound of said secondary metal and further comprising ethylenediamine as a palladium complexing agent and an organic brightening agent, wherein said brightening agent is 3-(3-pyridyl)acrylic acid, 3-(3-quinolyl)acrylic acid or a salt thereof.

2. The electrolysis bath according to claim 1, wherein said salt is an alkali metal salt.

3. The electrolysis bath according to claim 1, having a pH between 3 and 5.

4. The electrolysis bath according to claim 1, further comprising at least one metal acting as an inorganic brightening agent.

5. The electrolysis bath according to claim 1, wherein said palladium is present in an amount of from 1 to 100 g/l.

6. The electrolysis bath according to claim 1, wherein said at least one secondary metal is present at a concentration of between 0.1 and 60 g/l.

7. The electrolysis bath according to claim 1, comprising from 2 to 200 ml/l of said ethylenediamine.

8. The electrolysis bath according to claim 1, comprising from 0.01 to 3 g/l of said 3-(3-pyridyl)acrylic acid, 3-(3-quinolyl)acrylic acid or salt thereof as said brightening agent.

9. The electrolysis bath according to claim 1, further comprising at least 20 g/l of at least one conducting salt.

10. The electrolysis bath according to claim 9, wherein said conducting salt is selected from the group consisting of sodium sulfate, potassium sulfate and mixtures thereof.

11. The electrolysis bath according to claim 1, further comprising a buffer for stabilizing the pH.

12. The electrolysis bath according to claim 11, wherein said buffer is selected from the group consisting of acetic, citric, boric, lactic, malic, phtalic, acrylic, tartaric, oxalic and succinic buffers.

13. The electrolysis bath according to claim 1, further comprising a wetting agent.

14. The electrolysis bath according to claim 13, wherein said wetting agent is cetyltrimethylammonium bromide or iodide.

15. The electrolysis bath according to claim 1, further comprising an additive for reducing the internal tensions of a palladium deposit.

16. The electrolysis bath according to claim 1, wherein said palladium compound is palladium sulfate.

17. The electrolysis bath according to claim 1, wherein the palladium compound is a solid salt of palladium sulfate and said ethylenediamine which comprises from 31 to 41% of palladium and in which the molar ratio $[SO_4]$:[Pd] is between 0.9 and 1.15 and the ratio [ethylenediamine]:[Pd] is between 0.8 and 1.2.

18. The electrolysis bath according to claim 1, comprising at least one of said secondary metals introduced into said bath in the form of a sulfate, a carbonate, an hydroxide or a mixture thereof.

19. The electrolysis bath according to claim 1, wherein said secondary metal is cobalt.

20. The electrolysis bath according to claim 1, wherein said secondary metal is nickel.

21. A process for the electro plating of palladium or a palladium alloy, comprising operating said electrolysis bath as defined in claim 1 by using current densities of between 0.5 and 150 $A/dm^2$.

22. The process according to claim 21, carried out using insoluble anodes and a metallized substrate as a cathode.

23. The process according to claim 22, wherein the insoluble anodes are platinized titanium, platinum coated with iridium oxide, or a precious metal.

* * * * *